United States Patent [19]

Korytov et al.

[11] 4,291,742

[45] Sep. 29, 1981

[54] METHOD AND APPARATUS FOR OBTAINING AN INGOT

[76] Inventors: Vladimir A. Korytov, ulitsa Nikolaevskaya, 9, kv. 64; Pavel P. Maljushevsky, prospekt Oktyabrsky, 17a, kv. 41; Grigory A. Guly, ulitsa Inzhenernaya, 13, kv. 5; Alexandr S. Shkatov, ulitsa Olshanskogo, 14, kv. 6, all of Nikolaev; Vladimir T. Sladkoshteev, ulitsa Dzerzhinskogo, 34, kv. 11, Kharkov; Ruslan V. Patanin, ulitsa Gagarina, 80, kv. 128, Kharkov; Vasily I. Dorokhov, ulitsa Dzerzhinskogo, 34, kv. 6, Kharkov; Georgy A. Klemeshov, ulitsa Pushkinskaya, 40, kv. 11, Kharkov; Grigory E. Arkulis, ulitsa Oktyabrskaya, 8, kv. 23, Magnitogorsk, all of U.S.S.R.

[21] Appl. No.: 849,992

[22] Filed: Nov. 9, 1977

[51] Int. Cl.[3] ..... B22D 27/02

[52] U.S. Cl. ..... 164/501; 164/71; 164/260; 164/416; 164/250

[58] Field of Search ..... 164/71, 83, 48, 49, 164/250, 147, 260, 261, 416

[56] References Cited

U.S. PATENT DOCUMENTS

| | | | |
|---|---|---|---|
| 2,848,775 | 8/1958 | Ettenriech | 164/71 |
| 3,434,187 | 3/1969 | Clark et al. | 164/250 |
| 3,845,806 | 11/1974 | Schekin et al. | 164/250 |
| 4,022,266 | 5/1977 | Vershinsky et al. | 164/250 |

FOREIGN PATENT DOCUMENTS

| | | | |
|---|---|---|---|
| 37-15463 | 9/1962 | Japan | 164/48 |
| 47-36614 | 9/1972 | Japan | 164/83 |
| 126585 | 3/1960 | U.S.S.R. | 164/48 |
| 420678 | 8/1974 | U.S.S.R. | 164/83 |
| 503635 | 3/1976 | U.S.S.R. | 164/250 |

*Primary Examiner*—R. L. Spruill
*Assistant Examiner*—K. Y. Lin
*Attorney, Agent, or Firm*—Lackenbach, Lilling & Siegel

[57] ABSTRACT

The invention relates to a method and apparatus for obtaining an ingot wherein elastic oscillations are directed on metal being crystallized over a broad frequency range and at high intensity in the form of powerful pulses generated by a high-voltage spark discharge in liquid. One form of the apparatus of the invention comprises a discharge chamber filled with liquid in contact with a mould or with melt. The discharge chamber is provided with a system of electrodes connected to a pulse current generator. Upon feeding high-voltage current pulses to the electrodes, high pressure, impulse flows, cavitation and surge waves are built-up in the liquid resulting in the appearance of elastic oscillations acting on the molten metal.

12 Claims, 8 Drawing Figures

METHOD AND APPARATUS FOR OBTAINING AN INGOT

BACKGROUND OF THE INVENTION

The invention relates to the metal production, and more specifically to a method and apparatus for obtaining an ingot.

The invention may be the most advantageously used in casting metal in moulds used in continuous and semi-continuous casting methods, electroslag and vacuum-arc remelting and in other production methods used for making ingots.

Improvement in the quality and structure of an ingot metal is very important in the metal casting technique and obtaining metal having uniform fine-grained structure is not yet completely resolved, especially in the production of heavy-weight castings.

Known in the art are methods of subjecting metals and alloys, in the course of crystallization, to the action of external factors using elastic oscillations provided by ultrasonic oscillations, magnetic field and low-frequency vibrations, and apparatus for effecting these methods.

The method of imparting ultrasonic oscillations to a melt in the course of crystallization has found the widest application.

An apparatus for processing molten metal with ultrasonic oscillations comprises an ultrasonic oscillator having a magnetostriction or piezoelectric converter, an ultrasonic emitter and a resonance tuning system for adjusting natural frequency of molten metal being processed and frequency of induced oscillations of the emitter.

Molten metal is poured into a mould, and the emitter is introduced into the molten metal through a hole in the mould bottom or from the top, through a hole in a mould top.

During the pouring of molten metal into the mould, the ultrasonic oscillator is energized, and ultrasonic oscillations are imparted to the molten metal thus resulting in destruction of growing dendrites and formation of fine-grained structure of the ingot metal. As the natural frequency of the metal (volume) being processed continuously varies during the pouring period, the resonance tuning system is used for automatically maintaining the equality of the natural and induced frequencies of the emitter and melt, respectively. A material disadvantage of this method is that the existing ultrasonic equipment employed for effecting the method has a low output capacity so that large volumes of metal cannot be processed. In addition, low strength of the emitter material does not enable the employment of ultrasonic oscillations for processing high-temperature alloys, such as steel. The provision of the resonance circuit working member/metal in the conditions of variable mass and volume of melt also results in certain technical problems.

It is also known to obtain an ingot using low-frequency vibrations in an apparatus intended for this purpose.

An apparatus for processing molten metal using low-frequency vibrations comprises a mould mounted on a vibrator. The vibrator comprises an electromagnetic system, a cam or eccentric drive, and hydraulic or pneumatic cylinders. Most frequently, the use is made of mechanical vibrators comprising an electric motor connected to a reducing gear and to a shaft journalled in bearings and having an unbalanced flywheel or an eccentric wheel. The shaft is coupled to the reducing gear by means of a clutch. The mould is mounted on the vibrator and filled with molten metal. The electric motor is turned on, and the mould receives oscillations in the vertical plane in accordance with a preset law of oscillations and with a predetermined amplitude and frequency.

It is, however, noted that the resulting elastic oscillations cannot destruct growing metal crystals since the wavelength of induced oscillations of the vibrator is of the order of several scores of meters, whereas the natural frequency of growing metal crystal is in the range of several kHz, that is any resonance is impossible.

Known apparatus designed for imparting elastic oscillations to molten metals provide for varying the oscillation frequency and amplitude in the discrete manner (low-frequency vibrators) or in the stepless manner, but over a very narrow frequency range (ultrasonic oscillators) which constitutes their material disadvantage. Therefore, the above-described methods for obtaining fine-grained uniform ingots have not found wide application in industry, especially in the production of heavyweight ingots.

SUMMARY OF THE INVENTION

It is an object of the invention to eliminate the above disadvantages.

It is an object of the invention to ensure a fine-grained metal structure in the central zone of the ingot, that is to prevent transcrystallization of metal.

Another object of the invention is to accelerate the crystallization of metal so as to improve productivity of the production equipment.

These and other objects are accomplished by a method for obtaining an ingot, wherein elastic oscillations are imparted to molten metal in the course of crystallization. The elastic oscillations imparted to the melt are shaped in the form of pulses generated by a high-voltage spark discharge in liquid during the time up to the beginning of volumetric crystallization of the melt, the pulse repetition rate and energy thereof being such as to prevent transcrystallization of metal.

The method of the invention is the first to provide for powerful action of elastic oscillations on large masses of metal up to hundreds of tons).

The method of the invention also enables the control of crystallization over a wide range of technical and energy parameters.

The invention further provides for obtaining metal having a uniform and fine-grained structure, permits an improvement of stiffness of the central zone of an ingot, and an increase in the yield of normal grade metal, rate of ingot formation and productivity of the equipment.

Furthermore, the method provides for an improved plasticity of the cast metal so that the degree of deformation may be increased in subsequent compression moulding.

Pulse repetition rate of spark discharge pulses is preferably within the range 0.3–5.0 Hz with a specific pulse energy of 0.5–1.5 kJ per one ton of molten metal and with the exposure time equal to $\frac{1}{3}$ of the total time for crystallization of metal in the ingot.

The above conditions enable an optimization of the ingot production process and a reduction of total power consumption for obtaining a desired technical result.

Spark discharge is preferably effected in a liquid having a resistivity above 0.50 Ohm.m so as to provide for high efficiency of high-voltage discharge.

If a liquid having a lower resistivity is used, concentrated energy release in the discharge chamber cannot be obtained.

The apparatus for effecting the method comprises a mould and a source of elastic oscillations to be imparted to molten metal. The source of elastic oscillations comprises at least one discharge chamber filled with a liquid having a resistivity above 0.5 Ohm.m and provided with electrodes, and a pulse current generator connected to the electrodes for shaping pulses by a high-voltage spark discharge in the liquid. The discharge chamber is mounted relative to the mould in such a manner that discharges occurring therein result in elastic oscillations in molten metal or melt contained in the mould. This apparatus provides the conditions for maximum concentration of applied energy per unit of melt volume.

The invention provides for acting on large masses of any liquid metal with low-frequency vibrations, ultrasonic oscillations and surge waves. Elastic oscillation generators are simple in structure and easy to manufacture, and they may be readily incorporated in any production process using the existing equipment. Thus, the provision of resonance tuning system working toolmetal becomes unnecessary.

Pulse repetition rate and energy are readily adjustable and may be varied over a wide range.

In accordance with one embodiment, the invention provides a source of elastic oscillations comprising two discharge chambers mounted opposite to each other and directly to the side walls of the mould. This arrangement enables the utilization of the effect of pressure increase in the melt at the front of converging waves.

The electrodes may be mounted in the discharge chamber at an angle of about 35°–75° to the longitudinal axis of the mould. This arrangement of the electrodes permits the melt to be used as an acoustic waveguide for elastic oscillations acting on the entire crystallization front of the metal ingot.

One embodiment of the invention resides in that the electrodes of the discharge chamber are mounted in a spaced relation to the ingot so that the point of intersection of their axes is within the zone of boundary between the solid and liquid phases of the ingot.

This feature provides for an increased service life of the electrodes and enables the application of elastic oscillations directly to the crystallization front.

The electrodes of the discharge chambers may be mounted in one and the same plane which is normal to the longitudinal axis of the mould. The mould has mounts at the outer side at the points of location of the discharge chambers, and each mount constituting, at the same time, the wall of the discharge chamber and the negative electrode.

This arrangement of the electrodes provides for the most optimum utilization of energy of the discharge and improves the reliability of the electrode system.

A funnel may be provided in the internal space of the discharge chamber for pouring metal into the mould which enables or provides for metal casting with various methods of casting.

When a funnel is used, the walls of the discharge chamber extending normally to the longitudinal axis of the mould are preferably made of a resilient material.

This particular feature provides for transmission of the leading edge of elastic oscillations without distortions.

The discharge chamber is preferably mounted relative to the mould in such a manner as to be partially immersed in the molten metal contained in the mould.

Such an arrangement of the chamber provides for an increased coefficient of energy transfer of elastic oscillations transmitted to the melt.

This embodiment of the apparatus enables a rapid elimination of overheating of metal in the mould so that the ingot formation is accelerated and a fine-grained ingot structure is obtained.

In addition, the above-described arrangement of the discharge chamber enables a reduction of the depth of a creater of molten metal in the ingot so that capital investments in the construction of continuous casting plants may be lowered.

BRIEF DESCRIPTION OF THE DRAWINGS

Other objects and advantages of the invention will become apparent from the following detailed description of specific embodiments thereof with reference to the accompanying drawings, in which.

DESCRIPTION OF THE PREFERRED EMBODIMENTS

Figure 1:
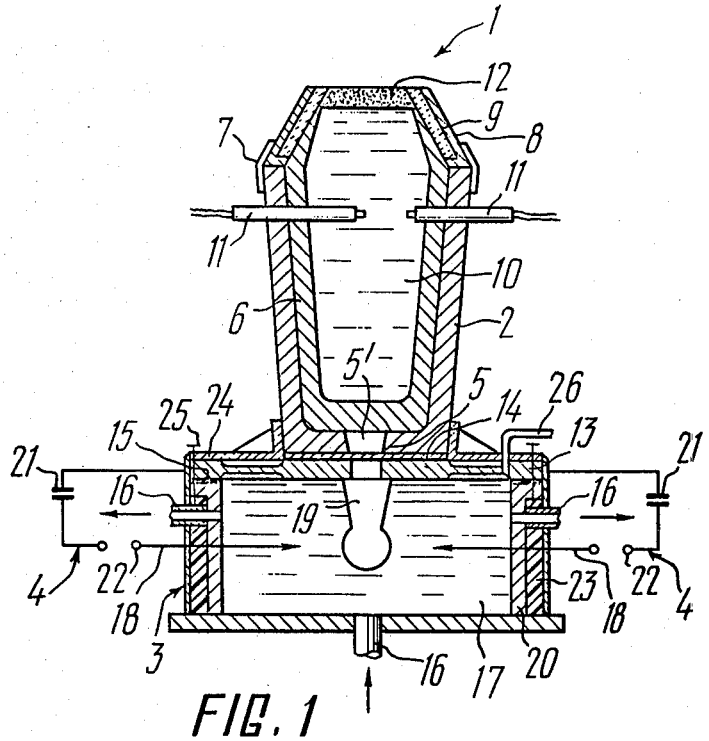
FIG. 1 shows a longitudinal sectional view of an apparatus for effecting the method the invention.

The apparatus 1, as best shown in FIG. 1, comprises a mould 2 mounted on a discharge chamber 3 and a pulse current oscillator 4. The mould 2 has, in its bottom portion, a hole 5 for positive removal of an ingot 6. The hole 5 is closed with a plug 5'. A mould top 8 is secured to the upper portion of the mould 2 by means of brackets 7. The inner surface of the top 8 is provided with a refractory lining 9 and the crystallization temperature of a melt 10 poured into the mould 2 is controlled by means of a thermocouple 11. The surface of the melt 10 is coated with a refractory composition 12, such as with a perlite and graphite powder mixture.

The discharge chamber 3 is of cylindrical shape and has a membrane 13 at its top portion. The membrane 13 is provided with a metal gasket 14 made of a metal with a low melting point, such as lead. The gasket 14 is used as an acoustic waveguide for surge waves transmitted from the discharge chamber 3 to the body of the mould 2 and to the melt 10. The discharge chamber 3 is made of steel. Between the discharge chamber 3 and the membrane 13 there is mounted a sealing gasket 15 made, e.g.

from an annealed copper sheet which is used for sealing off the discharge chamber 3. The discharge chamber 3 has pipes 16 for pumping a cooling liquid 17 having a resistivity above 0.5 ohm.m, such as water. The pipes 16 are mounted in the top and bottom parts of the discharge chamber 3 so as to ensure the permanent filling of the discharge chamber with cooling water during operation. The temperature of the liquid 17 in the discharge chamber 3 should not be above its boiling point.

The chamber 3 accomodates electrodes 18,19 of positive and negative polarity, respectively. The electrodes 18 are partially received in the cavity of the chamber 3 through a side wall 20 thereof, and the electrode 19 comprises a solid rod rigidly connected to the membrane 13 and mounted within the chamber 3 along the central vertical axis thereof.

Each of the electrodes 18,19 is connected to the oscillator 4 via an individual discharge circuit comprising a battery of capacitors 21 and a switching device, such as a spark gap 22.

The longitudinal axes of the electrodes 18 are directed toward the surface of the electrode 19.

The discharge chamber 3 is externally provided with a sound insulating layer 23 made, e.g. of foamed plastic.

The discharge chamber 3 is also provided with stops 24 fixed to the membrane 13 by means of bolts 25 which are used for aligning the mould 2 with the discharge chamber 3 and for preventing the displacement of the mould 2 during operation of the discharge chamber 3. In order to remove air from the chamber 3 during operation thereof, the internal space of the chamber 3 communicates with the atmosphere through a pipe 26 fixed to the membrane 13.

The parameters of the oscillator 4 should be such as to provide a specific pulse energy of 0.5–1.5 kJ per one ton of molten metal at a pulse repetition rate of 0.3–5.0 Hz with continuous operation of the oscillator under metal casting conditions for a time equal to $\frac{1}{3}$ of the total time of metal crystallization in the ingot.

The above-mentioned working range of the apparatus performance provides for optimum operating conditions in casting metals of various grades.

Prior to the metal pouring, the inner surface of the mould 2 is cleaned. Then the mould 2 is heated at 400°–480° C., and a layer of mould lubricant is applied to protect the inner surface of the mould 2 against oxidation when in contact with the molten metal. The mould top 8 is also preheated at 400°–480° C. and then mounted on the mould 2 and fixed in place by means of the brackets 7. The assembled mould 2 is placed on the discharge chamber 3 and aligned with the center of the membrane 13 by using the stops 24.

A system for supplying the cooling liquid 17 (not shown) is connected to the chamber 3, and the cooling liquid circulates through the pipes 16.

The apparatus according to the invention functions in the following manner.

Beginning with the commencement of metal pouring into the mould 2, high-voltage pulses at about 50 kV are applied from the pulse current oscillator 4 to the positive and negative electrodes 18, 19 at a pulse repetition rate of 0.3–5.0 Hz and with a specific energy of every pulse of 0.5–1.5 kJ per one ton of the melt 10. A spark discharge occurs between the electrodes 18, 19 in the cooling liquid 17 in the discharge chamber 3. The resulting surge waves, cavitation, impulse flows and acoustic oscillations of the liquid include highly intensive elastic oscillations in the melt 10, which are transmitted through the body of the negative electrode 19, membrane 13, gasket 14, mould 2 and the ingot body 6 and to the melt 10 being solidified.

Surge waves result from direct action of plasma pressure in the discharge channel which is of the order of several scores of thousands of atmospheres at the surface of the negative electrode 19, as well as imparting from break-through of the interelectrode gap of a widening plasma channel in the working liquid 17. It is noted that while the surge wave from the discharge channel releases its energy for creation of the force wave in the electrode-melt wave guide system, the energy of surge waves formed in the liquid 17 is used generally for inducing cavitation. At the same time, the presence of free surface in the closed volume of liquid contributes to an increased cavitation within the discharge chamber 3 and to the occurence of resonance in the system discharge chamber 3—mould 2. In operation, water vapours resulting from the discharge are continuously removed from the chamber 3 through the pipe 26. The discharge channel plasma, surge waves and cavitation generate a wide range of elastic oscillations at ultrasonic frequencies which result in destruction of crystals growing in the molten metal and their fracturing into finer crystals. High pressure built-up in the working liquid 17 result in pulse flows therein thus contributing to the formation of low-frequency elastic oscillations with high accelerations which act to destruct the front of growing crystals at the boundary between the solid and liquid phases of the ingot and to cause the crystal debris to settle at the bottom of the ingot 6. While flushing, the crystal debris results in lowering the temperature of the melt 10 and provides crystallization nuclei for growth of fresh crystals so that fine-grained metal structure is obtained due to volumetric crystallization of the melt 10. Elastic oscillations of the ingot being moulded contribute to an increase in the time of contact of the surface of the ingot 6 with the surface of the mould 2 so as to improve the heat removal from the ingot 6, while oscillations of the mould 2 provide for improvement of cooling thereof with ambient air so that the time of ingot moulding is reduced by 30–45% or more. Thus, better conditions are provided for gas release, and the depth of shrinkage flaws is reduced so that the yield of normal-grade metal is improved. The ingot should be processed beginning with the commencement of pouring of molten metal into the mould 2 until the beginning of the process of volumetric crystallization, the energy being sufficient for hampering the process of transcrystallization. After a predetermined processing time, the pulse current oscillator 4 is deenergized, and the mould 2 containing the ingot 6 is removed from the discharge chamber 3 for further cooling.

After the moulding of ingot is completed, the mould top 8 is removed, and the ingot 6 is withdrawn from the mould 2 for further utilization.

Figure 2:
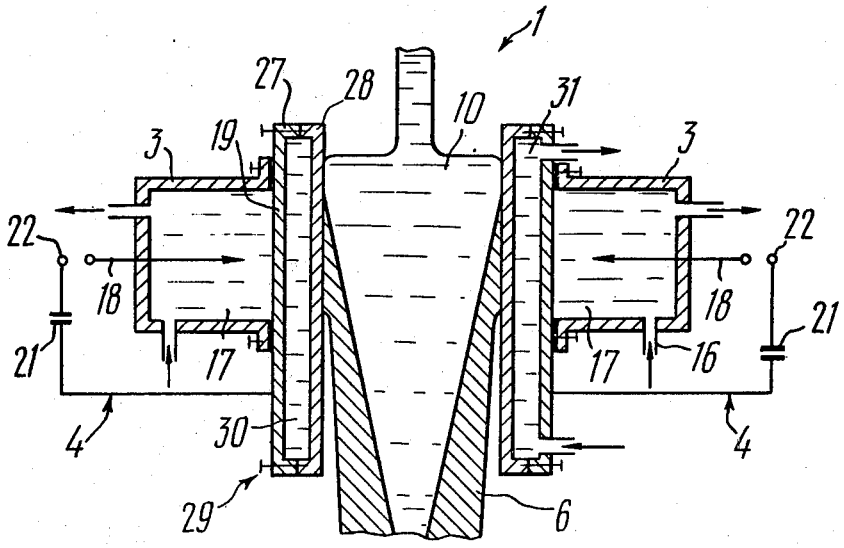
FIG. 2 shows a longitudinal sectional view of an embodiment of the apparatus.

FIG. 2 shows an embodiment of the apparatus, wherein the source of elastic oscillations is provided with two discharge chambers 3 mounted opposite to each other to side walls 27, 28 of a mould 29.

The chambers 3 are mounted to the upper part of the mould 29 at the zone of the beginning of crystallization of the melt 10. The walls 27, 28 of the mould 29 are provided with passages 30 for circulation of a cooling liquid 31, such as water. Each chamber 3 has an individual discharge circuit for the electrodes 18,19 connected to a common pulse current oscillator 4, the negative electrode being formed by the wall 27 of the mould 29.

The internal spaces of the discharge chambers of the mould are not connected to the passages 30 of the mould 29 so as not to interfere with the cooling conditions provided for the ingot 6. However, the cooling liquid 31 fed to the passages 30 may be used also as working liquid 17 in the discharge chamber 3. The discharge chambers 3 have the electrodes 18 of the linear system, that is the spark discharge occurs between the point of the positive electrode 18 and the wall 27 of the mould 29.

The provision of the two opposite discharge chambers 3 mounted to the side wall of the mould 29 permits utilization of the effect of collision of two opposite surge waves. The resultant third surge wave has higher parameters than the primary waves so that the efficiency of utilization of the energy fed to the melt is increased (FIG. 2). The same result is achieved when using electrodes mounted at a predetermined angle to the ingot 6 in the zone of cooling thereof.

Figure 3:
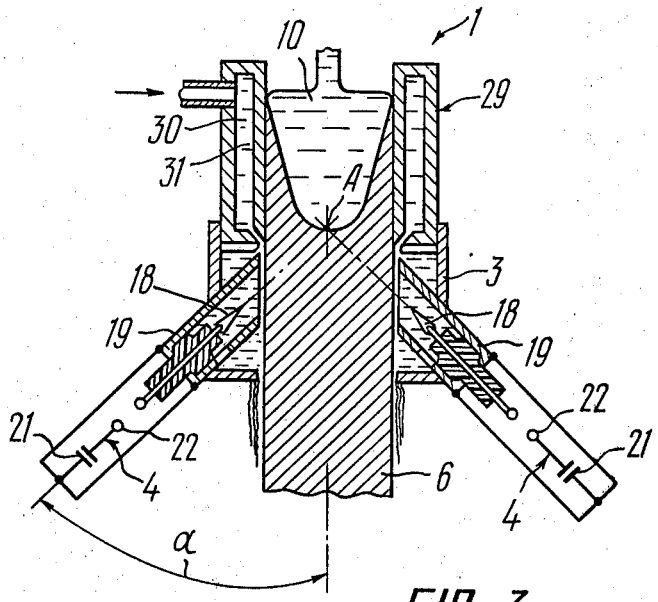
FIG. 3 shows a longitudinal sectional view illustrating an embodiment of the electrode arrangement in the discharge chamber of the apparatus.

FIG. 3 shows such an embodiment or arrangement of the electrodes mounted at a predetermined angle to the longitudinal axis of a mould 29 filled with the melt 10 which is being solidified into the ingot 6. The discharge chamber 3 is mounted beneath the mould 29 and has the electrodes 18,19 connected to the pulse current oscillator 4.

The directional electrode system of this apparatus differs from the linear electrode system shown in FIG. 2 in that the negative electrode 19 is coaxial with the positive electrode 18 and comprises a strong cylindrical body insulated from the electrode 18 extending along the longitudinal axis thereof.

The electrodes 18,19 are mounted within the discharge chamber 3 at an angle $\alpha$ of 35°–75° to the longitudinal axis of the ingot 6. The angle $\alpha$ of inclination of the electrodes depends on the dimensions and shape of the ingot 6 being moulded as well as on the chemical composition thereof.

Due to the wave action, plasma in the discharge channel is accelerated between the electrodes 18, 19, and flat compression waves are formed which collide in the zone of the boundary between the solid and liquid phases of the ingot 6 to destruct the front of growing crystals of metal.

The electrodes 18,19 are mounted in the discharge chamber 3 in a spaced relation to the body of the ingot 6, the point A of intersection of their longitudinal axes being within the zone of the boundary between the solid and liquid phases of the ingot 6. Elastic oscillations transmitted to the body of the ingot 6 and into the melt 10 being solidified destruct the front of growing metal crystals. Thus, since the elastic oscillations are introduced locally into the crystallization zone of the ingot, the efficiency of their action is improved.

Figure 4:
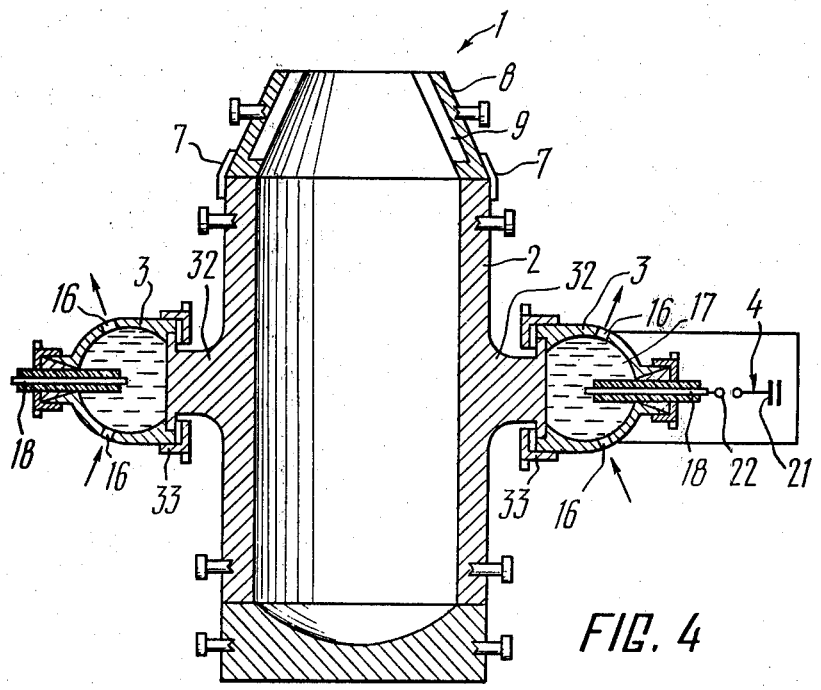
FIG. 4 shows a longitudinal sectional view of another embodiment of the apparatus.

FIG. 4 shows an embodiment of the apparatus, wherein two discharge chamber 3 are mounted in one and the same horizontal plane extending normally to the longitudinal axis of the mould 2. At the points of location of the discharge chambers, the mould 2 is externally provided with mounts 32. The inner surface of the discharge chamber 3 is shaped as a parabola. The positive electrode 18 is mounted along the longitudinal axis of the chamber 3. The chamber 3 is secured to the mount 32 by means of fasteners 33. The mount 32 is also used as the negative electrode. The mounts of the heavy-weight mould may comprise mounting journals made on the outer surface of the mould 2. The provision of the mounts 32 on the side surface of the mould 2 enables their utilization as a member of the discharge chamber, e.g. side wall of the discharge chamber and as the negative electrode. The mounts 32 are also used as structural members for securing the discharge chamber to the mould. The provision of the mounts contributes to the reduction of temperature stresses appearing during the cooling of the mould body heated after the metal pouring. The mounts also function as waveguides for elastic oscillations induced in the discharge chamber 3.

Therefore, the resulting surge waves propagate in the melt with minimum energy losses to destruct the front of growing crystals on the inner surface of the mould and on the side walls of the ingot being mounted.

Figure 5:
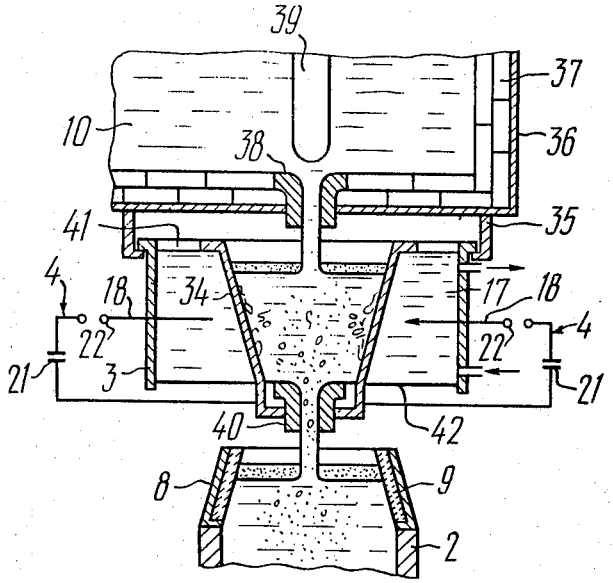
FIG. 5 shows a longitudinal sectional view of the discharge chamber having a funnel for pouring metal into the mould.

FIG. 5 shows the embodiment of the discharge chamber 3 having incorporated therein a funnel 34 for pouring metal into the mould 2, the longitudinal axis of the funnel 34 coinciding with the longitudinal axis of the chamber 3. This arrangement may be used in casting metal into a continuous casting mould, earth and sand moulds and in other applications.

The discharge chamber 3 is suspended by means of stops 35 from a pouring ladle 36. The ladle 36 has a refractory lining 37. The lower part of the ladle 36 has a pouring nozzle 38 adapted to be closed with a stopper 39.

The funnel 34 is also provided, at the lower part thereof, with a pouring nozzle 40 similar to the pouring nozzle 38.

The positive electrodes 18 connected to the pulse current oscillator 4 are directed toward the outer surface of the peripheral wall of the funnel 34 which constitutes the negative electrode. Walls 41,42 of the discharge chamber 3 extending normally to the longitudinal axis of the mould 2 are made in the form of steel membranes so that when elastic oscillations are induced in the chamber 3, the funnel 34 may oscilate in the vertical plane thus facilitating gas release from the molten metal.

The characteristic feature of the discharge chamber 3 having the pouring funnel 34 consists in that the metal solidified on the inner surface of the funnel 34 is continuously destructed under the action of the discharge energy, and the debris of metal crystals are entrained with the flow of melt into the mould 2. Thus, overheating of metal is reduced, and the crystal debris become crystallization nuclei. In order to the prevent molten metal from freezing in the funnel 34, the heat removal from the melt 10 should be strictly controlled, that is the amount of heat removed should be sufficient only for elimination of metal overheating.

Figure 6:
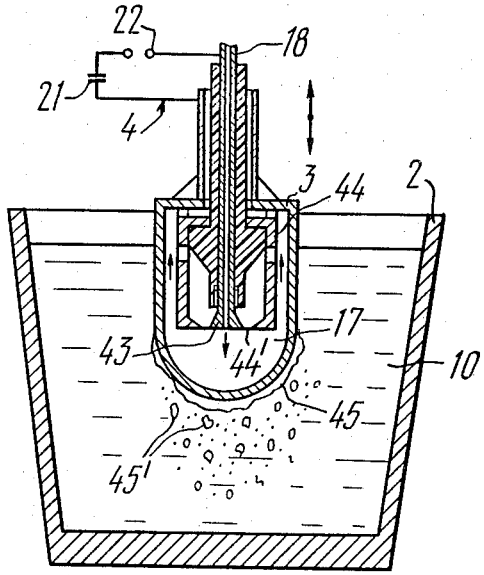
FIG. 6 shows a longitudinal sectional view illustrating the arrangement of the discharge chamber relative to the mould.

FIG. 6 shows an embodiment of the apparatus, wherein the discharge chamber 3 is mounted on the mould in such a mamnner that it is partially immersed in the melt 10, and there is provided a mechanism (not shown) for displacing the discharge chamber relative to the mould. The positive electrode 18 is in the form of a tube or hollow rod for passage of the cooling liquid 17 into the chamber 3 and has a replaceable annular tip 43 which is subjected to erosion and wear. The negative electrode comprises a cylindrical pipe 44. The longitudinal axes of the electrodes 18,44 coincide with each other. The annular space 44' between the annular tip 43 and the electrode 44 is the working gap for the spark discharge.

In the operation of the apparatus shown in FIG. 6, a skin 45 of metal is formed on the outer surface of the chamber 3 which is destructed under the action of elastic oscillations, and the debris of the crystals 45' become crystallization nuclei. Thus, a considerable amount of heat is removed from the molten metal so that the size of the crater with liquid phase in the continuous metal casting is reduced.

Figure 7:
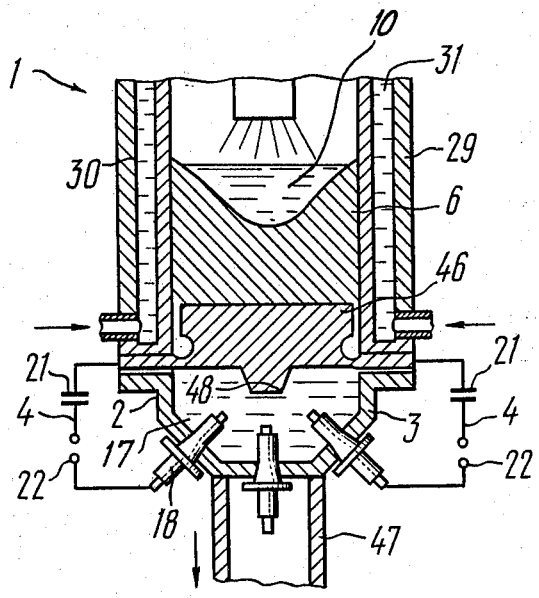
FIG. 7 shows a longitudinal sectional view illustrating another arrangement of the discharge chamber relative to the mould.

FIG. 7 shows an embodiment of the apparatus having the discharge chamber 3 located adjacent to a dummy bar 46 of the mould 29. The chamber 3 is connected to a drawbar 47 of a mechanism for withdrawing the ingot 6 from the mould 29 (not shown). This arrangement may be used in electroslag, vacuum-arc or electron-beam remelting, semicontinuous casting and in other metal production methods. The dummy bar 46 has a projection 48 directed toward the discharge chamber 3 and forming the negative electrode, and the positive electrodes 18 are mounted in the chamber 3 and directed toward the surface of the projection 48 of the dummy bar 46.

Figure 8:
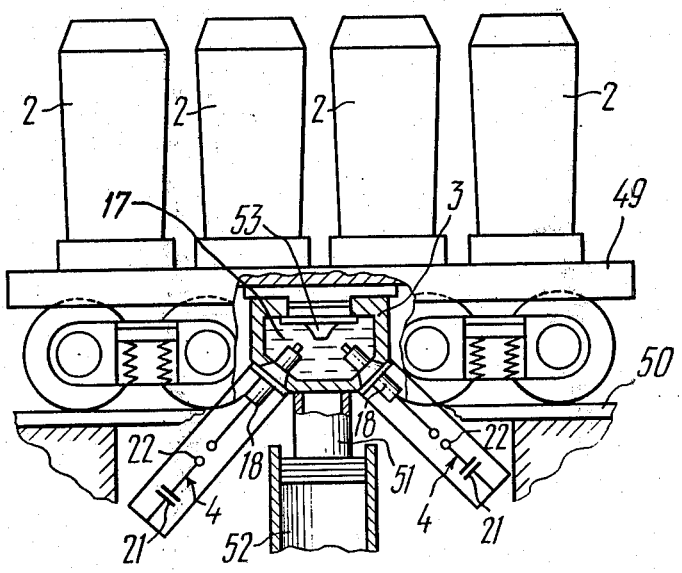
FIG. 8 shows a side elevational view illustrating an embodiment of the apparatus having several moulds.

This embodiment features the utilization of the ingot 6 being moulded as a waveguide for elastic oscillations transmitted from the discharge chamber 3 into the melt 10 at the top portion of the ingot 6. Thus, the ingot 6 receives oscillations in the vertical plane. The use of vertical oscillations of the ingot 6 being formed result in reduced friction between the surface of the ingot 6 and the mould 29 thus prolonging the service life of the apparatus and lowering the force required for withdrawing the ingot 6 from the mould 29. In order to improve productivity of casting in making several ingots, a plurality of moulds 2 may be used, as best shown in FIG. 8, which are mounted on a platform 49 displaceable along rails 50. The discharge chamber 3 is mounted between the rails 50 on a piston rod 51 of a cylinder 52. The discharge chamber 3 has the positive electrodes 18 mounted at an angle to the vertical and directed toward a projection 53 of a cover plate 54 of the chamber 3. The projection 53 is used as the negative electrode. After the platform 49 is wheeled up to the pouring site for pouring metal into the moulds, the discharge chamber 3 is fed, on the piston rod 51, to the platform 49 to bear against the bottom of the platform. When metal is poured into the mould 2, the pulse current oscillator 4 is energized.

Under the action of pulse discharge in the discharge chamber 3, there appear elastic oscillations acting on the melt in all the moulds 2 through the platform 49.

What is claimed is:

1. An improved method for obtaining an ingot formed in a mould comprising: imparting a single source of elastic oscillations on metal melt undergoing crystallization, said elastic oscillations being within the range of the natural or resonant frequencies of said ingot and being in the form of pulses generated by a high-voltage spark discharge across a liquid having a resistivity above 0.5 Ohm.m., and thereafter inducing said elastic pulse oscillations simultaneously with the filling of said mould with molten metal and imparting same to the melt undergoing crystallization, until the beginning of the process of volumetric crystallization of the melt, and the pulse repetition rate and pulse energy being such as to prevent transcrystallization of said metal; whereby heavy weight ingots can be produced free of dendrites or metal crystals and of a more fine-grained uniform structure.

2. A method claimed in claim 1, wherein the pulse repetition rate of spark discharge pulses is within the range of 0.3–5.0 Hz with a specific pulse energy of 0.5–1.5 kJ per one ton of molten metal and with the exposure time of $\frac{1}{3}$ of the total time of metal crystallization in the ingot.

3. An apparatus for obtaining an ingot comprising: a mould adapted to contain molten metal; a source of elastic oscillations transmitted to the molten metal and comprising at least one substantially closed discharge chamber filled with a liquid having a resistivity above 0.5 Ohm.m, said chamber being provided with a plurality of electrodes, and a pulse current oscillator connected to the positive and negative electrodes for pulse shaping by a high-voltage spark discharge in said liquid, said discharge chamber being mounted in mutual cooperative association with said mould such that high-voltage discharges occurring in said discharge chamber induce elastic oscillations in the molten metal contained in said mould.

4. An apparatus as claimed in claim 3, wherein the source of elastic oscillations comprises two discharge chambers which are mounted opposite to each other.

5. An apparatus as claimed in claim 4, wherein the electrodes are mounted in the discharge chamber at an angle of 35°–75° to the longitudinal axis of the mould.

6. An apparatus as claimed in claim 3, wherein the electrodes are mounted in the discharge chamber in a spaced relation to the ingot in such a manner that the point of intersection of the longitudinal axes thereof is within the zone of the boundary between the solid and liquid phases of the ingot.

7. An apparatus as claimed in claim 3, wherein the electodes in the discharge chambers are mounted in one and some plane extending normally to the longitudinal axis of the mould, the mould being externally provided, at the points of location of the discharge chambers, with mounts, each mount being used both as the wall of the discharge chamber and as the negative electrode.

8. An apparatus as claimed in claim 3, wherein the discharge chamber is mounted relative to the mould in such a manner that it is partially immersed in the melt of metal contained in the mould.

9. The apparatus as claimed in claim 3, wherein the positive and negative electrodes are coaxially disposed.

10. The apparatus as claimed in claim 3, wherein said positive electrodes are disposed normal to the longitudinal axis of said mould.

11. An apparatus for obtaining an ingot comprising: a mould adapted to contain molten metal; a source of elastic oscillations comprising at least one substantially closed discharge chamber provided with a funnel for pouring molten metal into the said funnel being mounted within the internal space of discharge chamber said chamber being filled with a liquid having a resistivity above 0.5 Ohm.m, and said chamber being provided with a plurality of electrodes, and a pulse current oscillator connected to the positive and negative electrodes for pulse shaping by a high-voltage spark discharge in said liquid, said discharge chamber being mounted in mutual cooperative association with said mould such that high-voltage discharges occurring in said discharge chamber induce elastic oscillations in the molten metal contained in said funnel.

12. An apparatus as claimed in claim 11, wherein walls of the discharge chamber extending normally to the longitudinal axis of the mould are made of a resilient material.

* * * * *